US008400464B2

(12) United States Patent
Tsai et al.

(10) Patent No.: US 8,400,464 B2
(45) Date of Patent: Mar. 19, 2013

(54) LIQUID CRYSTAL DISPLAY AND METHOD FOR IMAGE-DITHERING COMPENSATION

(75) Inventors: Tsung-Hsien Tsai, Taichung County (TW); Shu-Wei Chang, Hsinchu (TW); Chun-Mu Yan, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 496 days.

(21) Appl. No.: 12/687,950

(22) Filed: Jan. 15, 2010

(65) Prior Publication Data

US 2011/0037782 A1 Feb. 17, 2011

(30) Foreign Application Priority Data

Aug. 13, 2009 (TW) ..... 98127250 A

(51) Int. Cl.
*G09G 5/02* (2006.01)

(52) U.S. Cl. ..... 345/596; 345/87

(58) Field of Classification Search ..... 345/87–89, 345/690, 204, 596

See application file for complete search history.

(56) References Cited

U.S. PATENT DOCUMENTS

| | | | | |
|---|---|---|---|---|
| 7,839,413 | B2 * | 11/2010 | Liao | 345/581 |
| 8,013,876 | B2 * | 9/2011 | Chung et al. | 345/690 |
| 8,102,351 | B2 * | 1/2012 | Tang | 345/96 |
| 2010/0202047 | A1 * | 8/2010 | Maximus et al. | 359/464 |
| 2010/0207959 | A1 * | 8/2010 | Qi et al. | 345/597 |
| 2012/0013657 | A1 | 1/2012 | Tang | |

FOREIGN PATENT DOCUMENTS

| | | | |
|---|---|---|---|
| CN | 101231402 | A | 7/2008 |
| TW | 200832328 | A | 8/2008 |

* cited by examiner

*Primary Examiner* — Ricardo L Osorio
(74) *Attorney, Agent, or Firm* — Rabin & Berdo, P.C.

(57) ABSTRACT

A liquid crystal display including a pixel array, multiple control lines and a driving unit is provided. The pixel array has multiple pixels. The control lines are coupled to the pixels. The driving unit drives the pixel array via the control lines. Of the pixels coupled to the same control line, the number of image-dithering compensated pixels with positive polarity is equal to the number of image-dithering compensated pixels with negative polarity when the pixel array is driven.

10 Claims, 8 Drawing Sheets

LIQUID CRYSTAL DISPLAY AND METHOD FOR IMAGE-DITHERING COMPENSATION

This application claims the benefit of Taiwan application Serial No. 98127250, filed Aug. 13, 2009, the subject matter of which is incorporated herein by reference.

BACKGROUND OF THE INVENTION

1. Field of the Invention

The invention relates in general to a liquid crystal display and an image dithering compensation method, and more particularly to a liquid crystal display and an image dithering compensation method capable of resolving the frame-flickering problem.

2. Description of the Related Art

The conventional image dithering compensation method adopts a method similar to color-mixing method to obtain more grey levels in spatial domain or temporal domain by using a small number of grey levels. Referring to FIG. 1, a conventional image dithering compensation method is shown. Let a 4×4 pixel array be taken for example. The pixel array 102~108 is continuous on the time axis in sequence, wherein the dashed-line areas respectively denote the pixels which are compensated due to image dithering. Thus, color-mixing effect, which is hard to detect with human eyes, can be achieved no matter the pixels are in spatial domain or temporal domain. Therefore, high-resolution output can be produced by smaller data input.

The liquid crystal molecules cannot be fixed at a particular level of voltage, otherwise liquid crystal molecules whose properties are destroyed cannot be rotated to form different grey levels in response to the change in electrical field. Therefore, the polarity of the pixel must be inverted for every period of time. The positive polarity and the negative polarity are alternated lest the properties of the liquid crystal molecules in the pixels might be jeopardized. However, the polarity inversion accompanied by image dithering compensation may easily result in frame flickering due to the bias in common voltage.

Referring to FIG. 2, a conventional the polarity inversion accompanied by image dithering compensation is shown. Let an 8×8 pixel array which is driven by dot inversion be taken for example. However, the exemplification is not limited thereto. Presumably, the 8×8 pixel arrays 202~208 respectively perform image dithering compensation by four 4×4 pixel arrays 102~108. It is understood from the observation of the pixel arrays 202~208 that the image-dithering compensated pixels in each row have the same polarity, and the image-dithering compensated pixels in each column also have the same polarity. For example, the compensated pixels in the pixel row 210 of the pixel array 202 all have negative polarity, and the compensated pixels in the pixel column 212 of the pixel array 208 all have positive polarity. As the common voltage, which is used as reference voltage by the pixel array, may easily be biased due to the factors in the manufacturing process, the compensated brightness will not be uniformed if the compensated pixels have the same polarity. Thus, frame flickering that can be easily detected with human eyes occurs.

SUMMARY OF THE INVENTION

The invention is directed to a liquid crystal display and an image dithering compensation method, which overcome the bias in common voltage by the complementary condition of the polarities between pixels so as to resolve the frame-flickering problem.

According to a first aspect of the present invention, a liquid crystal display including a pixel array, multiple control lines and a driving unit is provided. The pixel array has multiple pixels. The control lines are coupled to the pixels. The driving unit drives the pixel array via the control lines. Of the pixels coupled to the same control line, the number of image-dithering compensated pixels with positive polarity is equal to the number of image-dithering compensated pixels with negative polarity when the pixel array is driven.

According to a second aspect of the present invention, an image dithering compensation method adapted in a liquid crystal display is provided. The liquid crystal display includes a pixel array, multiple control lines and a driving unit. The pixel array includes multiple pixels. The control lines are coupled to the pixels. The driving unit drives the pixel array via the control lines. The method includes the following steps. Firstly, a pixel array is driven. Next, image dithering compensation is performed to a part of pixels in the pixel array. Of the pixels coupled to the same control line, the number of image-dithering compensated pixels with positive polarity is equal to the number of image-dithering compensated pixels with negative polarity.

The invention will become apparent from the following detailed description of the preferred but non-limiting embodiments. The following description is made with reference to the accompanying drawings.

DETAILED DESCRIPTION OF THE INVENTION

The invention provides a liquid crystal display and an image dithering compensation method, which overcome the bias in common voltage by the complementary condition of the polarities between pixels so as to resolve the frame-flickering problem.

The invention disclosed a liquid crystal display including a pixel array, multiple control lines and a driving unit. The pixel array includes multiple pixels. The control lines are coupled to the pixels. The driving unit drives the pixel array via the control lines. Of the pixels coupled to the same control line, the number of image-dithering compensated pixels with positive polarity is equal to the number of image-dithering compensated pixels with negative polarity when the pixel array is driven.

Figure 1:
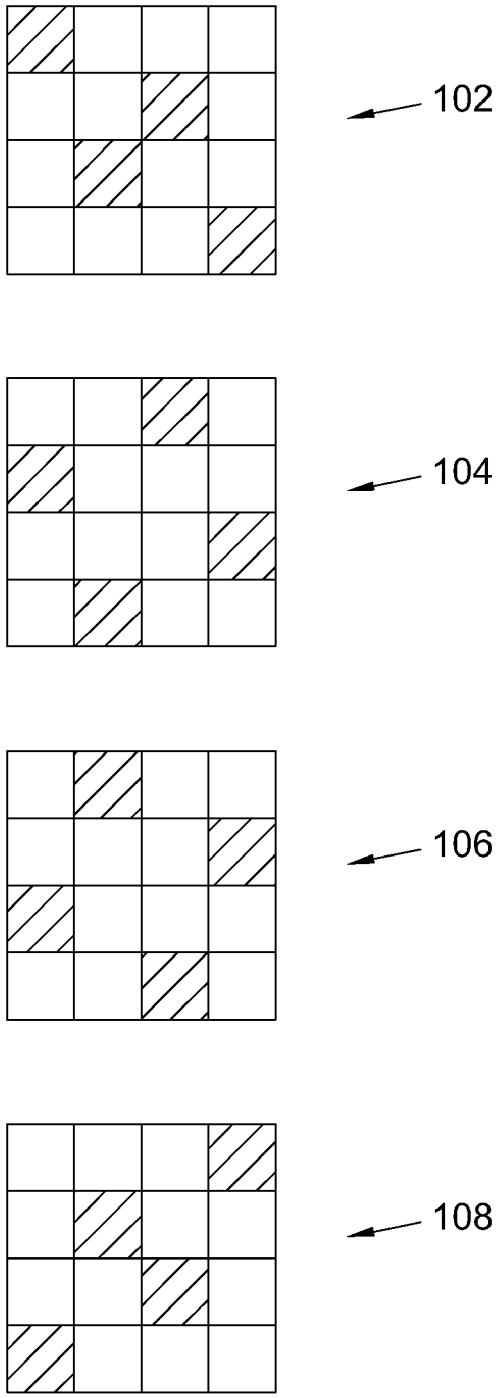
FIG. 1(PRIOR ART)
FIG. 1 shows a conventional image dithering compensation method.
Figure 2:
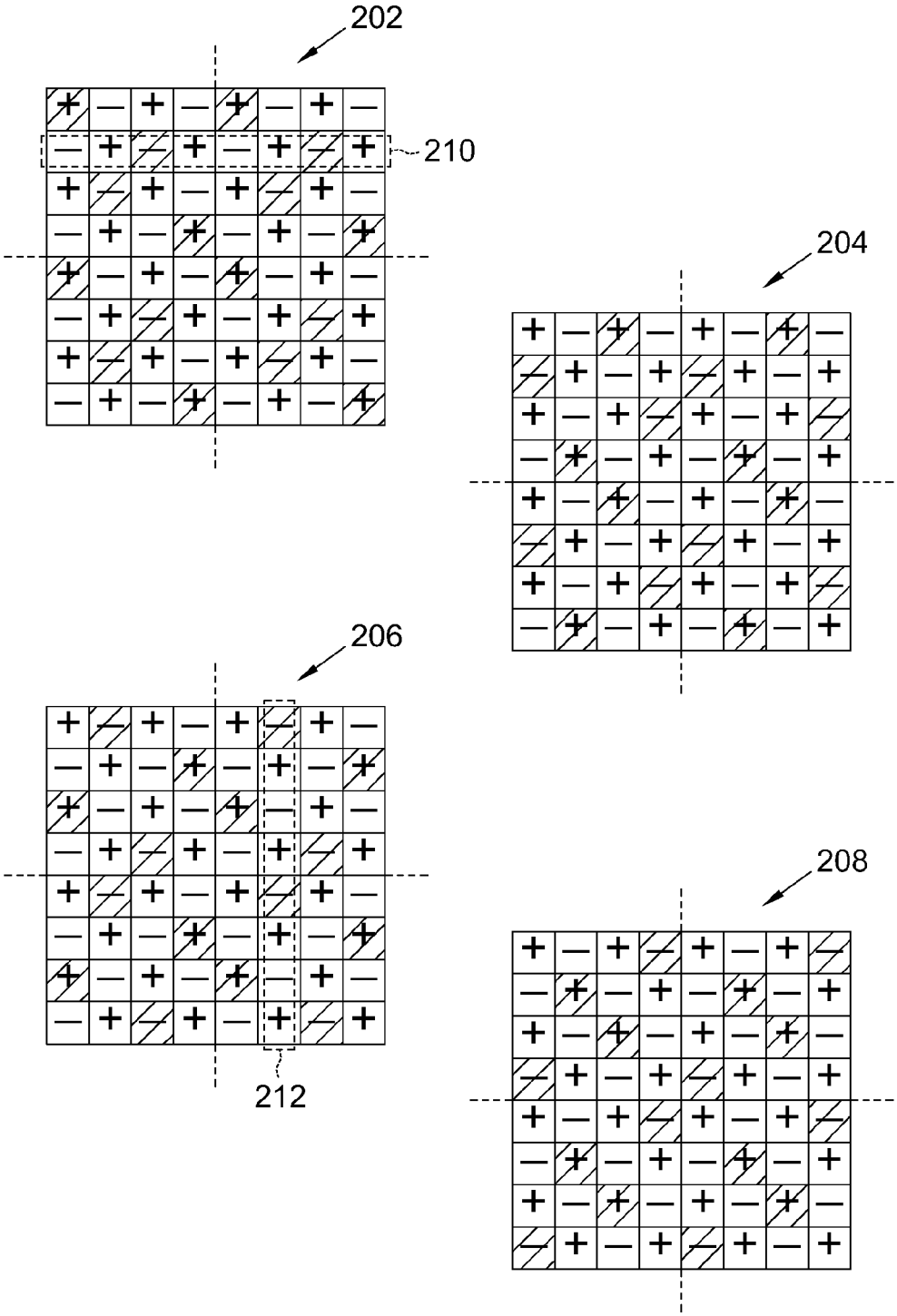
FIG. 2(PRIOR ART)
FIG. 2 shows a conventional the polarity inversion accompanied by image dithering compensation.
Figure 3:
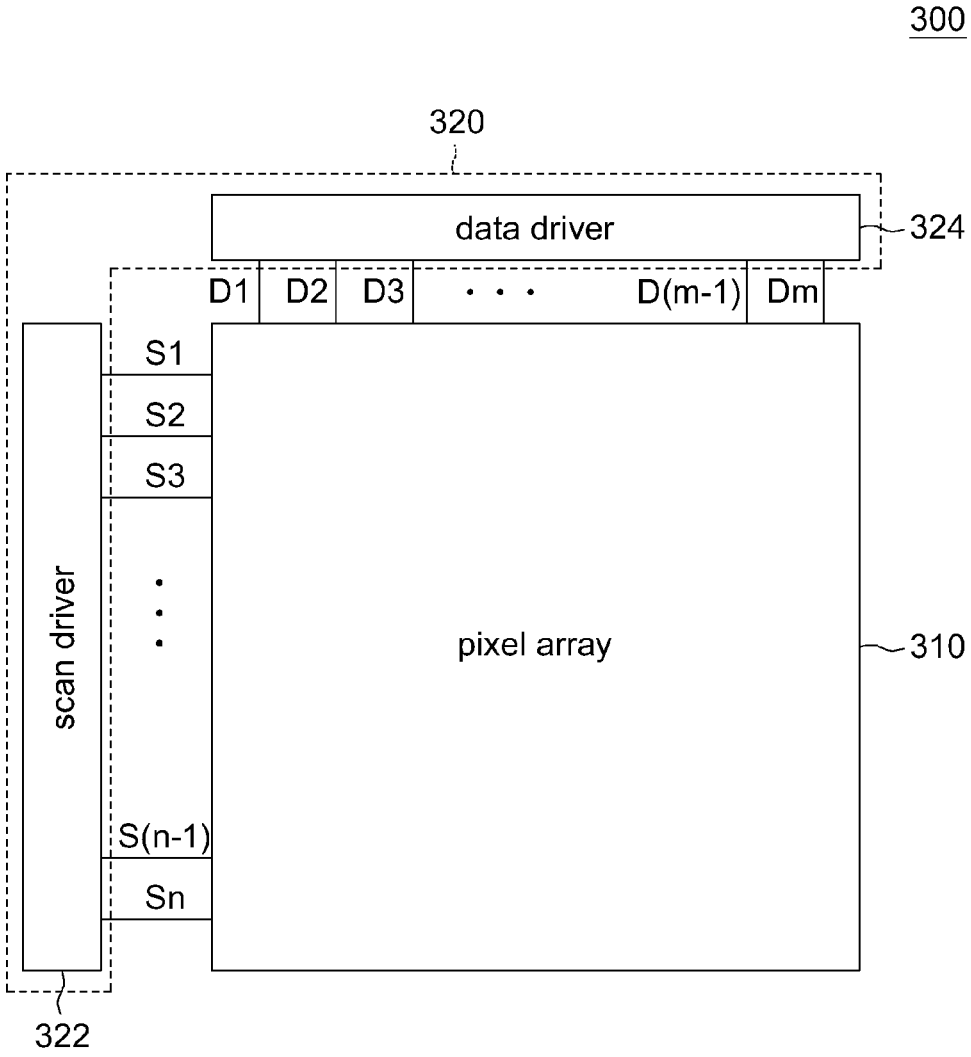
FIG. 3 shows a liquid crystal display according to a preferred embodiment of the invention.

Referring to FIG. 3, a liquid crystal display according to a preferred embodiment of the invention is shown. The liquid crystal display 300 includes a pixel array 310, multiple control lines and a driving unit 320. The pixel array 310 is an m×n pixel array. The control lines are coupled between the pixel array 310 and the driving unit 320. In the following exemplification, the pixel array 310 is an 8×8 pixel array, and the pixel array 310 is respectively driven by dot inversion, line inversion or column inversion but is not limited thereto.

First~Third Embodiment

Figure 4:
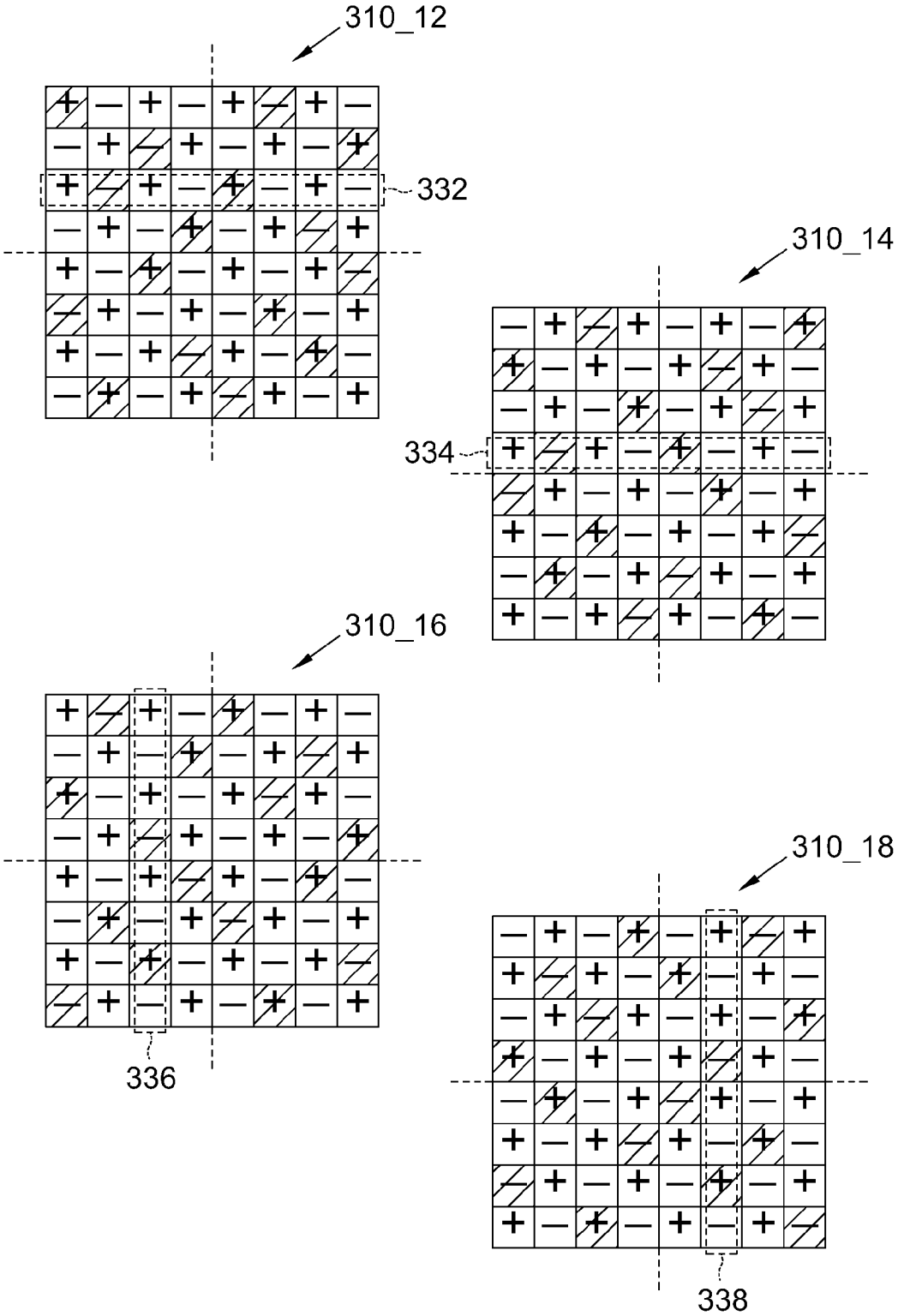
FIG. 4 shows a first example of the polarity inversion accompanied by image dithering compensation according to a preferred embodiment of the invention.

In the liquid crystal display 300, the driving unit 320 includes a scan driver 322 and a data driver 324. A part of control lines is such as multiple scan lines, and another part of control lines is such as multiple data lines. Each pixel of the pixel array 310 corresponds to one of the scan lines and one of the data lines respectively. Referring to FIG. 4, a first example of the polarity inversion accompanied by image dithering compensation according to a preferred embodiment of the invention is shown. The pixel array 310 is driven by dot inversion but is not limited thereto. In FIG. 4, the pixel arrays 310_12~310_18 denote the pixel array 310 being continuous on the time axis in sequence, and the dashed-line areas respectively denote the pixels compensated due to image dithering.

It is understood from the observation of the pixel arrays 310_12~310_18 that when the pixel array 310 is driven by dot inversion, in the pixel row coupled to the same scan line, the number of image-dithering compensated pixels with positive polarity is equal to the number of image-dithering compensated pixels with negative polarity, and in the pixel column coupled to the same scan line, the number of image-dithering compensated pixels with positive polarity is equal to the number of image-dithering compensated pixels with negative polarity. For example, the polarities of the compensated pixels in the pixel row 332 of the pixel array 310_12 achieve balance, the polarities of the compensated pixels in the pixel row 334 of the pixel array 310_14 achieve balance, the polarities of the compensated pixels in the pixel column 336 of the pixel array 310_16 achieve balance, and the polarities of the compensated pixels in pixel column 338 of the pixel array 310_18 also achieve balance.

If the driving unit 320 adopts a dual-gate structure, then the pixel array 310 can also be driven by (1+2) dot inversion or 2 dot inversion.

Figure 5:
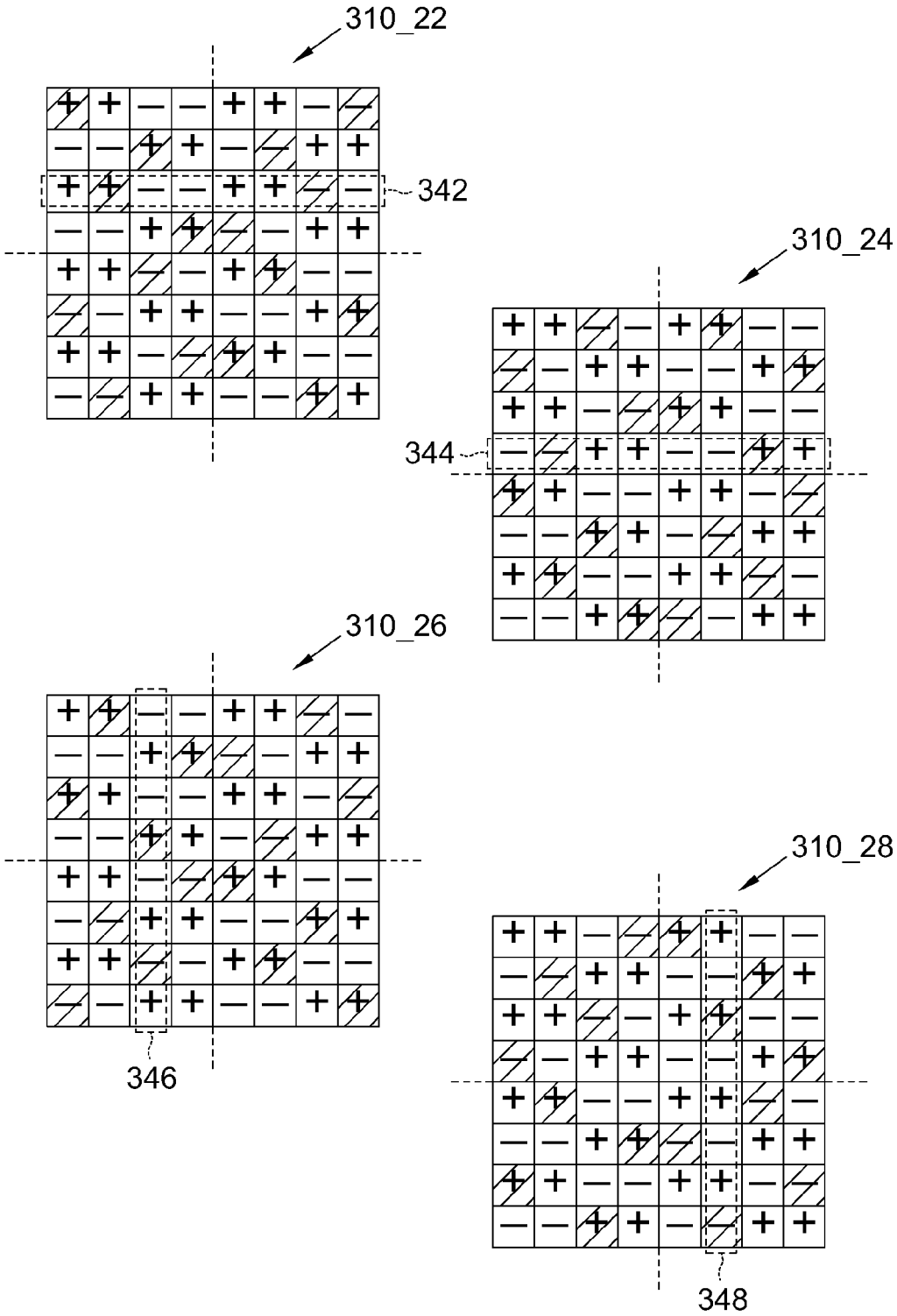
FIG. 5 shows a second example of the polarity inversion accompanied by image dithering compensation according to a preferred embodiment of the invention.

Referring to FIG. 5, a second example of the polarity inversion accompanied by image dithering compensation according to a preferred embodiment of the invention is shown. In FIG. 5, the pixel array 310 is driven by 2 dot inversion but is not limited thereto. In response to 2 dot inversion, in a single 4×4 pixel array of the pixel array 310, the polarities of every two pixels in each pixel row are inverted once, and the polarities of adjacent pixels in each pixel column are also inverted once. In FIG. 5, the pixel arrays 310_22~310_28 denote the pixel array 310 being continuous on the time axis in sequence, and the dashed-line areas respectively denote the pixels compensated due to image dithering.

It is understood from the observation of the pixel arrays 310_22~310_28 that when the pixel array 310 is driven by 2 dot inversion, in the pixel row coupled to the same scan line, the number of image-dithering compensated pixels with positive polarity is equal to the number of image-dithering compensated pixels with negative polarity, and in the pixel column coupled to the same scan line, the number of image-dithering compensated pixels with positive polarity is equal to the number of image-dithering compensated pixels with negative polarity. For example, the polarities of the compensated pixels in the pixel row 342 of the pixel array 310_22 achieve balance, the polarities of the compensated pixels in the pixel row 344 of the pixel array 310_24 achieve balance, the polarities of the compensated pixels in the pixel column 346 of the pixel array 310_26 achieve balance, and the polarities of the compensated pixels in the pixel column 348 of the pixel array 310_28 also achieve balance.

Figure 6:
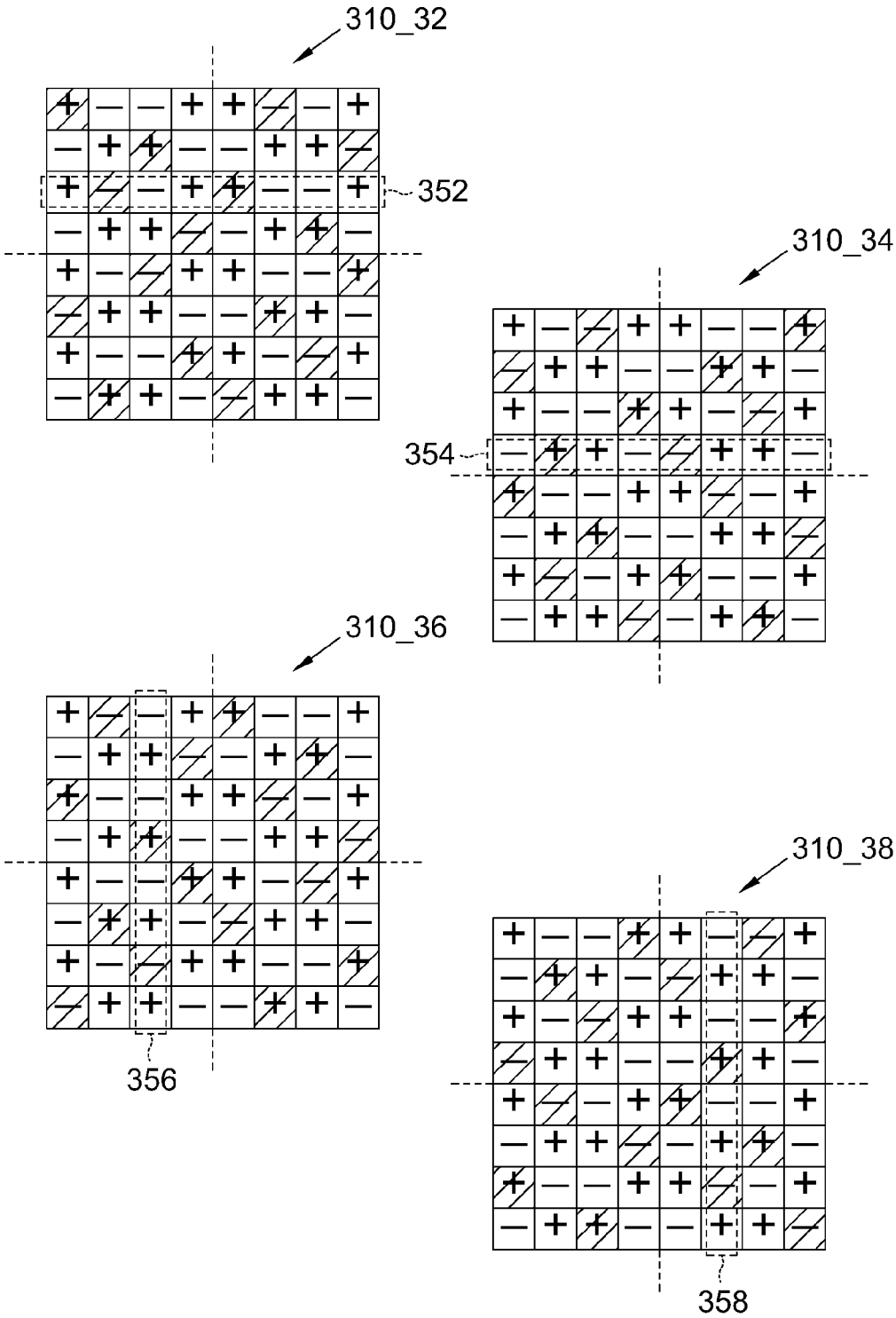
FIG. 6 shows a third example of the polarity inversion accompanied by image dithering compensation according to a preferred embodiment of the invention.

Referring to FIG. 6, a third example of the polarity inversion accompanied by image dithering compensation according to a preferred embodiment of the invention is shown. In FIG. 6, the pixel array 310 is (1+2) driven by dot inversion but is not limited thereto. In response to (1+2) dot inversion, in a single 4×4 pixel array of the pixel array 310, the polarities between the first pixel and the second pixel in each pixel row is inverted once, the polarities between the third pixel and the fourth pixel in each pixel row are inverted once, and the polarities of adjacent pixels in each column are inverted once. In FIG. 6, the pixel arrays 310_32~310_38 denote the pixel array 310 being continuous on the time axis in sequence, and the dashed-line areas respectively denote the pixels compensated due to image dithering.

It is understood from the observation of the pixel array 310_32~310_38 that when the pixel array 310 is (1+2) driven by dot inversion, in the pixel row coupled to the same scan line, the number of image-dithering compensated pixels with positive polarity is equal to the number of image-dithering compensated pixels with negative polarity, and in the pixel column coupled to the same scan line, the number of image-dithering compensated pixels with positive polarity is equal to the number of image-dithering compensated pixels with negative polarity. For example, the polarities of the compensated pixels in the pixel row 352 of the pixel array 310_32 achieve balance, the polarities of the compensated pixels in the pixel row 354 of the pixel array 310_34 achieve balance, the polarities of the compensated pixels in the pixel column 356 of the pixel array 310_36 achieve balance, and the polarities of the compensated pixels in the pixel column 358 of the pixel array 310_38 also achieve balance.

Thus, despite the common voltage which is used as a reference voltage by the pixel array 310 may easily be biased due to the factors in the manufacturing process, the compensated brightness will approach balance and become hard to detect by human eyes as long as the polarities of the compensated pixels achieve balance. As the frame flickering is hard to detect with human eyes, the frame-flickering problem can thus be resolved.

Fourth Embodiment

Figure 7:
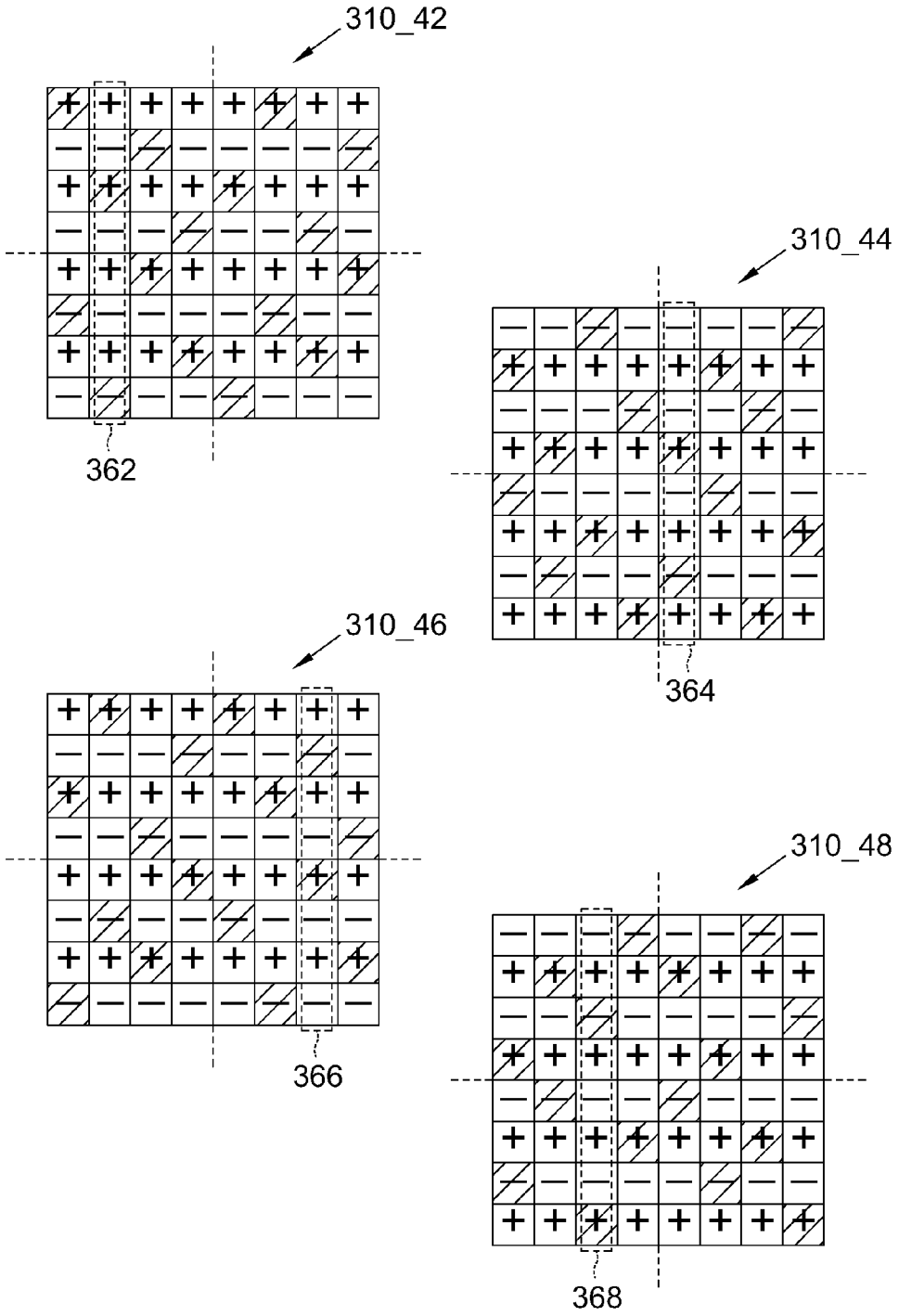
FIG. 7 shows a fourth example of the polarity inversion accompanied by image dithering compensation according to a preferred embodiment of the invention.

In the liquid crystal display 300, the driving unit 320 includes a data driver 324. Multiple control lines are such as multiple data lines. Each pixel of the pixel array 310 respectively corresponds to one of the data lines. Referring to FIG. 7, a fourth example of the polarity inversion accompanied by image dithering compensation according to a preferred embodiment of the invention is shown. The pixel array 310 is driven by line inversion, but is not limited thereto, and can also be driven by dot inversion, (1+2) dot inversion or 2 dot inversion for example. In FIG. 7, the pixel arrays 310_42~310_48 denote the pixel array 310 being continuous on the time axis in sequence, and the dashed-line areas respectively denote the pixels compensated due to image dithering.

It is understood from the observation of the pixel array 310_42~310_48 that when the pixel array 310 is driven by line inversion, in the pixel column coupled to the same scan line, the number of image-dithering compensated pixels with positive polarity is equal to the number of image-dithering compensated pixels with negative polarity. For example, the polarities of the compensated pixels in the pixel column 362 of the pixel array 310_42 achieve balance, the polarities of the compensated pixels in the pixel column 364 of the pixel array 310_44 achieve balance, the polarities of the compensated pixels in the pixel column 366 of the pixel array 310_46 achieve balance, the polarities of the compensated pixels in the pixel column 368 of the pixel array 310_48 achieve balance.

Thus, despite the common voltage, which is used as a reference voltage by the pixel array 310, may easily be biased due to the factors in the manufacturing process, the overall brightness will be compensated and approach balance as long as the polarities of the compensated pixels in the same pixel column achieve balance. As the compensated brightness is hard to detect with human eyes, the frame-flickering problem can thus be resolved.

Fifth Embodiment

Figure 8:
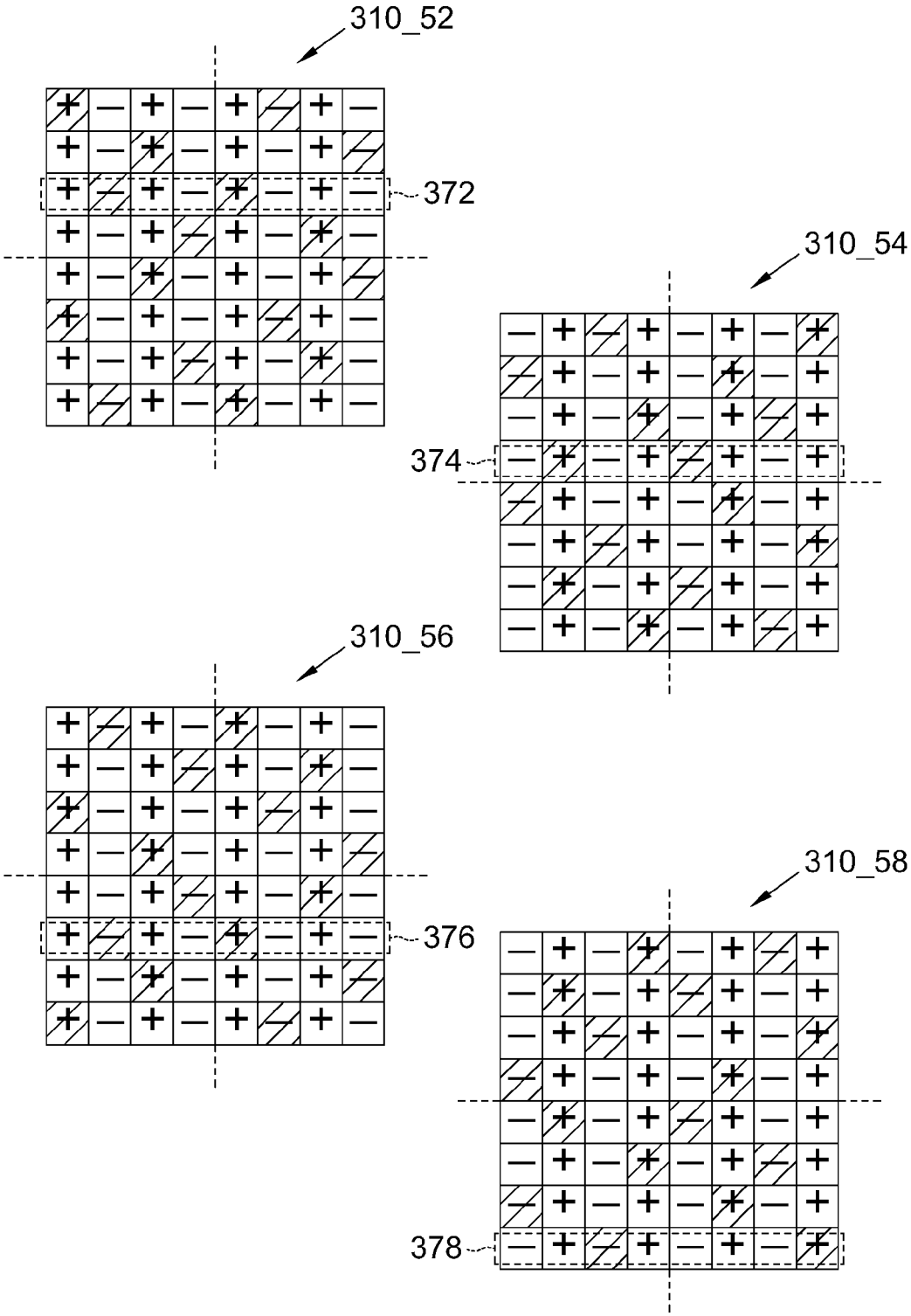
FIG. 8 shows a fifth example of the polarity inversion accompanied by image dithering compensation according to a preferred embodiment of the invention.

In the liquid crystal display 300, the driving unit 320 includes a scan driver 322. Multiple control lines are such as multiple scan lines. Each pixel of the pixel array 310 respectively corresponds to one of the scan lines. Referring to FIG. 8, a fifth example of the polarity inversion accompanied by image dithering compensation according to a preferred embodiment of the invention is shown. The pixel array 310 is driven by column inversion, but is not limited thereto, and can also be driven by dot inversion, (1+2) dot inversion or 2 dot inversion. In FIG. 8, the pixel arrays 310_52~310_58 denote the pixel array 310 being continuous on the time axis in sequence, and the dashed-line areas respectively denote the pixels compensated due to image dithering.

It is understood from the observation of the pixel array 310_52~310_58 that when the pixel array 310 is driven by column inversion, in the pixel row coupled to the same scan line, the number of image-dithering compensated pixels with positive polarity is equal to the number of image-dithering compensated pixels with negative polarity. For example, the polarities of the compensated pixels in the pixel row 372 of the pixel array 310_52 achieve balance, the polarities of the compensated pixels in the pixel row 374 of the pixel array 310_54 achieve balance, the polarities of the compensated pixels in the pixel row 376 of the pixel array 310_56 achieve balance, and the polarities of the compensated pixels in the pixel row 378 of the pixel array 310_58 achieve balance.

Thus, despite the pixel array 310, which is used as a reference voltage by the common voltage, may easily be biased due to the factors in the manufacturing process, the overall brightness will be compensated and approach balance as long as the polarities of the compensated pixels in the same pixel row achieve balance. As the compensated brightness is hard to detect with human eyes, the frame-flickering problem can thus be resolved.

The invention also provides an image dithering compensation method adapted in a liquid crystal display. The liquid crystal display includes a pixel array, multiple control lines and a driving unit. The pixel array has multiple pixels. The control lines are coupled to the pixels. The driving unit drives the pixel array via the control lines. The method includes the following steps. Firstly, the pixel array is driven. Next, image dithering compensation is performed to a part of pixels in the pixel array. Of the pixels coupled to the same control line, the number of image-dithering compensated pixels with positive polarity is equal to the number of image-dithering compensated pixels with negative polarity.

The liquid crystal display and the image dithering compensation method disclosed in the above embodiments of the invention have many advantages exemplified below:

According to the liquid crystal display and the image dithering compensation method of the invention, the number of image-dithering compensated pixels with positive polarity in the same pixel row or the same pixel column is enabled to be equal to the number of image-dithering compensated pixels with negative polarity in the same pixel row or the same pixel column, so as to balance the polarity and uniform the overall brightness, hence resolving the frame-flickering problem caused by the bias in common voltage generated due to the factors in the manufacturing process.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display, comprising:

a pixel array having a plurality of pixels arranged in rows and columns;

a plurality of control lines coupled to the pixels; and a driving unit for driving the pixel array via the control lines;

wherein, of the pixels coupled to the same control line, the number of image-dithering compensated pixels with positive polarity is equal to the number of image-dithering compensated pixels with negative polarity when the pixel array is driven; and wherein the driving unit comprises a data driver, the control lines are a plurality of data lines, and in a column of the pixels that are coupled to the same data line, the number of image-dithering compensated pixels with positive polarity is equal to the number of image-dithering compensated pixels with negative polarity when the pixel array is driven.

2. The liquid crystal display according to claim 1, wherein the driving unit further comprises a scan driver, the scan driver corresponds to a plurality of scan lines, and in a row of the pixels that are coupled to the same scan line, the number of image-dithering compensated pixels with positive polarity is equal to the number of image-dithering compensated pixels with negative polarity when the pixel array is driven.

3. The liquid crystal display according to claim 2, wherein the pixel array is driven by dot inversion, column inversion, (1+2) dot inversion or 2 dot inversion.

4. The liquid crystal display according to claim 1, wherein the pixel array is driven by dot inversion, line inversion, (1+2) dot inversion or 2 dot inversion.

5. The liquid crystal display according to claim 1, wherein the driving unit further comprises a scan driver, the scan driver corresponds to a plurality of scan lines, each pixel of the pixel array corresponds to one of the scan lines and one of the data lines respectively, and when the pixel array is driven by dot inversion, in a row of the pixels coupled to the same scan line, the number of image-dithering compensated pixels with positive polarity is equal to the number of image-dithering compensated pixels with negative polarity.

6. An image dithering compensation method adapted in a liquid crystal display, the liquid crystal display comprises a pixel, a plurality of control lines and a driving unit, wherein the pixel array has a plurality of pixels arranged in rows and columns, the control lines are coupled to the pixels, the driving unit drives the pixel array via the control lines, and the method comprises:

driving the pixel array and performing image dithering compensation to a part of pixels in the pixel array;

wherein of the pixels coupled to the same control line, the number of image-dithering compensated pixels with positive polarity is equal to the number of image-dithering compensated pixels with negative polarity, and the driving unit comprises a data driver, the control lines are a plurality of data lines, and the method further comprises:

driving the pixel array and performing image dithering compensation to a part of pixels in the pixel array;

wherein, in a column of the pixels that are coupled to the same data line, the number of image-dithering compensated pixels with positive polarity is equal to the number of image-dithering compensated pixels with negative polarity.

7. The image dithering compensation method according to claim 6, wherein the driving unit further comprises a scan driver, the scan driver corresponds to a plurality of scan lines, and the method further comprises:

driving the pixel array and performing image dithering compensation to a part of pixels in the pixel array;

wherein, in a row of the pixels that are coupled to the same scan line, the number of image-dithering compensated pixels with positive polarity is equal to the number of image-dithering compensated pixels with negative polarity.

8. The image dithering compensation method according to claim 7, wherein the pixel array is driven dot inversion, column inversion, (1+2) dot inversion or 2 dot inversion.

9. The image dithering compensation method according to claim 6, wherein the pixel array is driven dot inversion, line inversion or, (1+2) dot inversion or 2 dot inversion.

10. The liquid crystal display the image dithering compensation method according to claim 6, wherein the driving unit further comprises a scan driver, the scan driver corresponds to a plurality of scan lines, each pixel of the pixel array corresponds to one of the scan lines and one of the data lines respectively, and the method further comprises:

driving the pixel array by dot inversion and performing image dithering compensation to a part of pixels in the pixel array;

wherein, in a row of the pixels that are coupled to the same scan line, the number of image-dithering compensated pixels with positive polarity is equal to the number of image-dithering compensated pixels with negative polarity.

* * * * *